US007145119B1

(12) United States Patent
Kim et al.

(10) Patent No.: US 7,145,119 B1
(45) Date of Patent: Dec. 5, 2006

(54) MICROWAVE COOKER HAVING ANTENNA IN COOPERATION WITH MOVABLE STIRRER

(75) Inventors: Kwang-Yong Kim, Seoul (KR); Eung-Su Kim, Seoul (KR); Young-Min Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/330,255

(22) Filed: Jan. 12, 2006

(30) Foreign Application Priority Data

Aug. 10, 2005 (KR) ..... 10-2005-0073492

(51) Int. Cl.
*H05B 6/72* (2006.01)
*H05B 6/74* (2006.01)
*H05B 6/78* (2006.01)

(52) U.S. Cl. ..... 219/749; 219/751

(58) Field of Classification Search ..... 219/746–751, 219/695–697

See application file for complete search history.

(56) References Cited

U.S. PATENT DOCUMENTS 2,618,735 A * 11/1952 Hall ..... 219/748
2,920,174 A * 1/1960 Haagensen ..... 219/751
4,476,362 A * 10/1984 Kusunoki et al. ..... 219/748

* cited by examiner

*Primary Examiner*—Philip H. Leung
(74) *Attorney, Agent, or Firm*—Birch, Stewart, Kolasch & Birch, LLP

(57) ABSTRACT

A microwave cooker includes a body having a cooking chamber therein, a microwave source disposed at the body for generating a microwave, a wave guide for guiding the microwave generated from the microwave source into the cooking chamber, a rotation antenna installed in the body to be rotatable by a driving motor for emitting the microwave guided by the wave guide into the cooking chamber, and a movable stirrer coupled to the rotation antenna so as to be interworked with the rotation antenna.

15 Claims, 9 Drawing Sheets

MICROWAVE COOKER HAVING ANTENNA IN COOPERATION WITH MOVABLE STIRRER

BACKGROUND OF THE INVENTION

1. Field of the Invention

The present invention relates to a microwave cooker, and more particularly, to a microwave cooker for heating and cooking food by uniformly scanning microwave generated from a magnetron to the food.

2. Description of the Background Art

A microwave cooker such as a microwave oven serves to heat and cook food by scanning microwave generated from a magnetron to the food.

FIG. 1 is a perspective view showing a microwave cooker in accordance with the conventional art, and FIG. 2 is a longitudinal section view showing the microwave cooker in accordance with the conventional art.

As shown in FIGS. 1 and 2, the conventional microwave cooker comprises a body 10 having a cooking chamber 12 for cooking food therein, a turn table 13 rotatably disposed at a floor of the cooking chamber 12, a door 20 openably coupled to one side of the body 10 for opening and closing an opening of the cooking chamber 12, a magnetron 30 disposed at an inner side of the body 10 for generating microwave, a wave guide 40 disposed to be adjacent to the magnetron 30 for guiding microwave generated from the magnetron 30 into the cooking chamber 12, and a driving motor 50 disposed at a lower portion of the body 10 for rotating the turn table 13.

In the conventional microwave cooker, a user puts food to be cooked on the turn table 13 of the cooking chamber 12, and closes the door 20. Then, the user operates an adjustment unit 21, so that microwave generated from the magnetron 30 is guided into the cooking chamber 12 through the wave guide 40. The microwave guided into the cooking chamber 12 is incident into the food disposed on the turn table 30, thereby heating and cooking the food.

The microwave cooker heats food by using microwave having a certain wavelength. One of the most important techniques is to uniformly heat food.

However, in the conventional microwave cooker, if the user does not put food just on the center of the turn table, food disposed on the turn table is not uniformly heated and cooked.

Also, food particles can remain in a gap below the turn table, so that inside of the cooking chamber becomes dirty easily. Furthermore, it is very hard to clean food particles inside the gap below the turn table at the time of cleaning the cooking chamber.

BRIEF DESCRIPTION OF THE INVENTION

Therefore, an object of the present invention is to provide a microwave cooker capable of uniformly heating and cooking food by effectively emitting microwave in a cooking chamber by firstly emitting microwave by rotating a rotation antenna by a driving motor, and then by secondly emitting the microwave by linearly sliding a movable stirrer by the rotation antenna.

To achieve these and other advantages and in accordance with the purpose of the present invention, as embodied and broadly described herein, there is provided a microwave cooker, comprising: a body having a cooking chamber therein; a microwave source disposed at the body for generating microwave; a wave guide for guiding microwave generated from the microwave source into the cooking chamber; a rotation antenna installed in the body to be rotatable by a driving motor for emitting microwave guided by the guide wave into the body; and a movable stirrer coupled to the rotation antenna so as to be interworked with the rotation antenna, and movable in back and forth directions of the cooking chamber.

The movable stirrer is provided with a first guide slot at a center thereof in a longitudinal direction thereof, and is provided with a second guide slot at both sides thereof in a width direction thereof. A first guide pin is inserted into the first guide slot of the movable stirrer, thereby connecting the rotation antenna and the movable stirrer to each other. A second guide pin is inserted into the second guide slot thus to be fixed to the body.

Preferably, at least two second guide pins are inserted into the second guide slot of the movable stirrer.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a microwave cooker according to the present invention will be explained in more detail with reference to the attached drawings.

Figure 1:
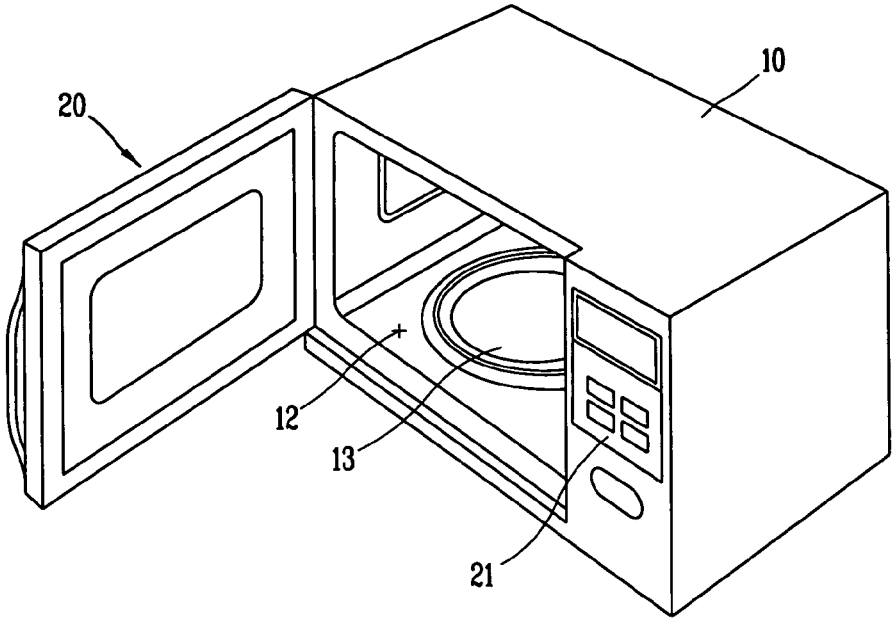
FIG. 1 CONVENTIONAL ART
FIG. 1 is a perspective view showing a microwave cooker in accordance with the conventional art.
Figure 2:
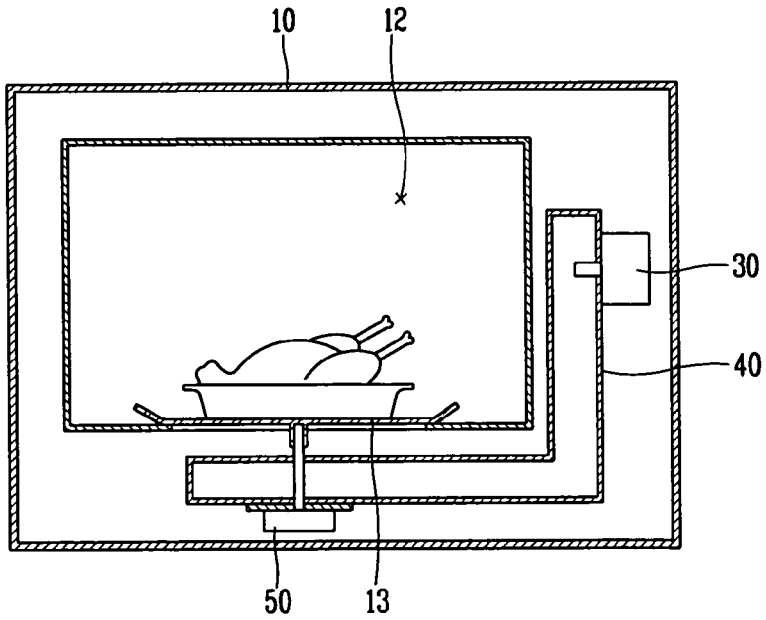
FIG. 2 CONVENTIONAL ART
FIG. 2 is a longitudinal section view showing the microwave cooker in accordance with the conventional art.
Figure 3:
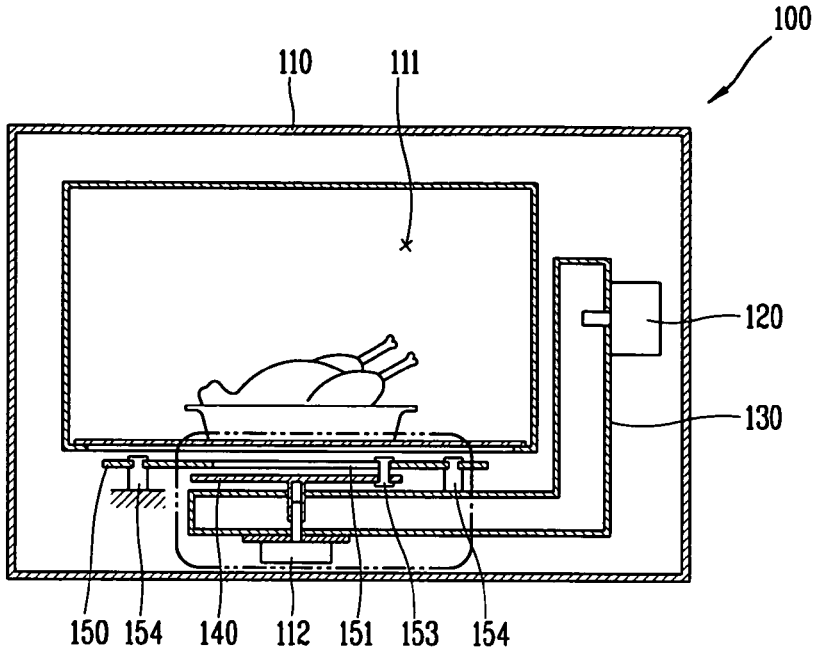
FIG. 3 is a longitudinal section view showing a microwave cooker according to a first embodiment of the present invention.
Figure 4:
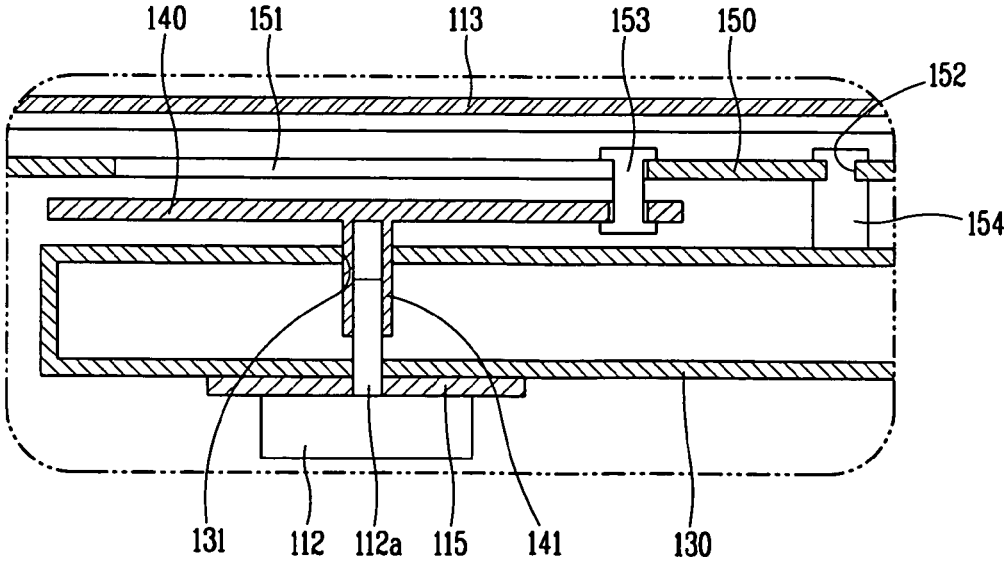
FIG. 4 is an enlarged view showing a main part of FIG. 3.
Figure 5:
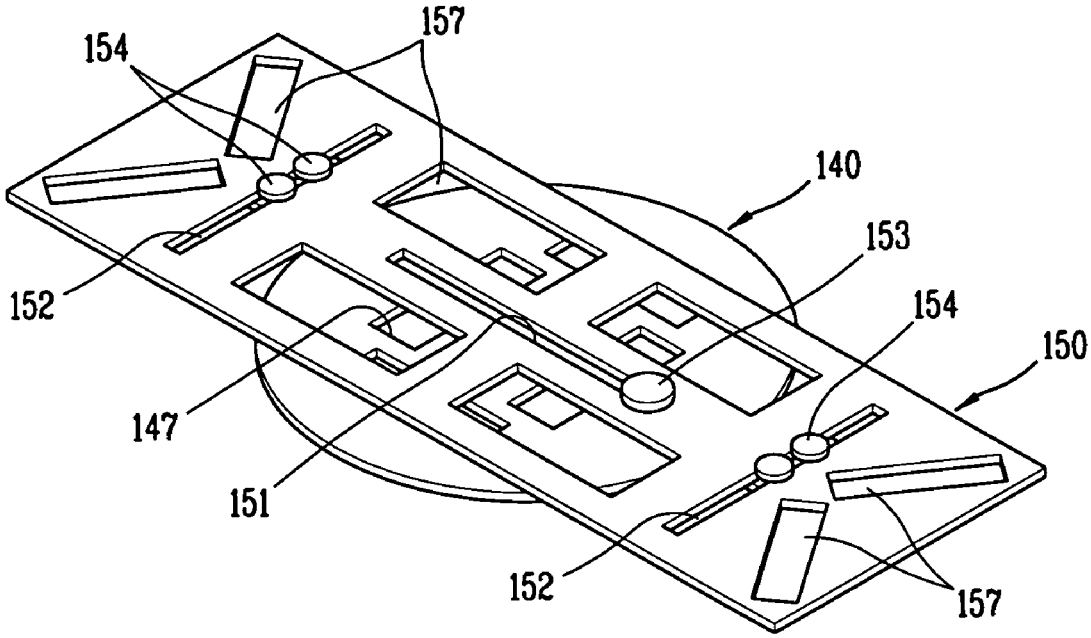
FIG. 5 is an assembled perspective view showing a rotation antenna and a movable stirrer in the microwave cooker according to a first embodiment of the present invention.
Figure 6:
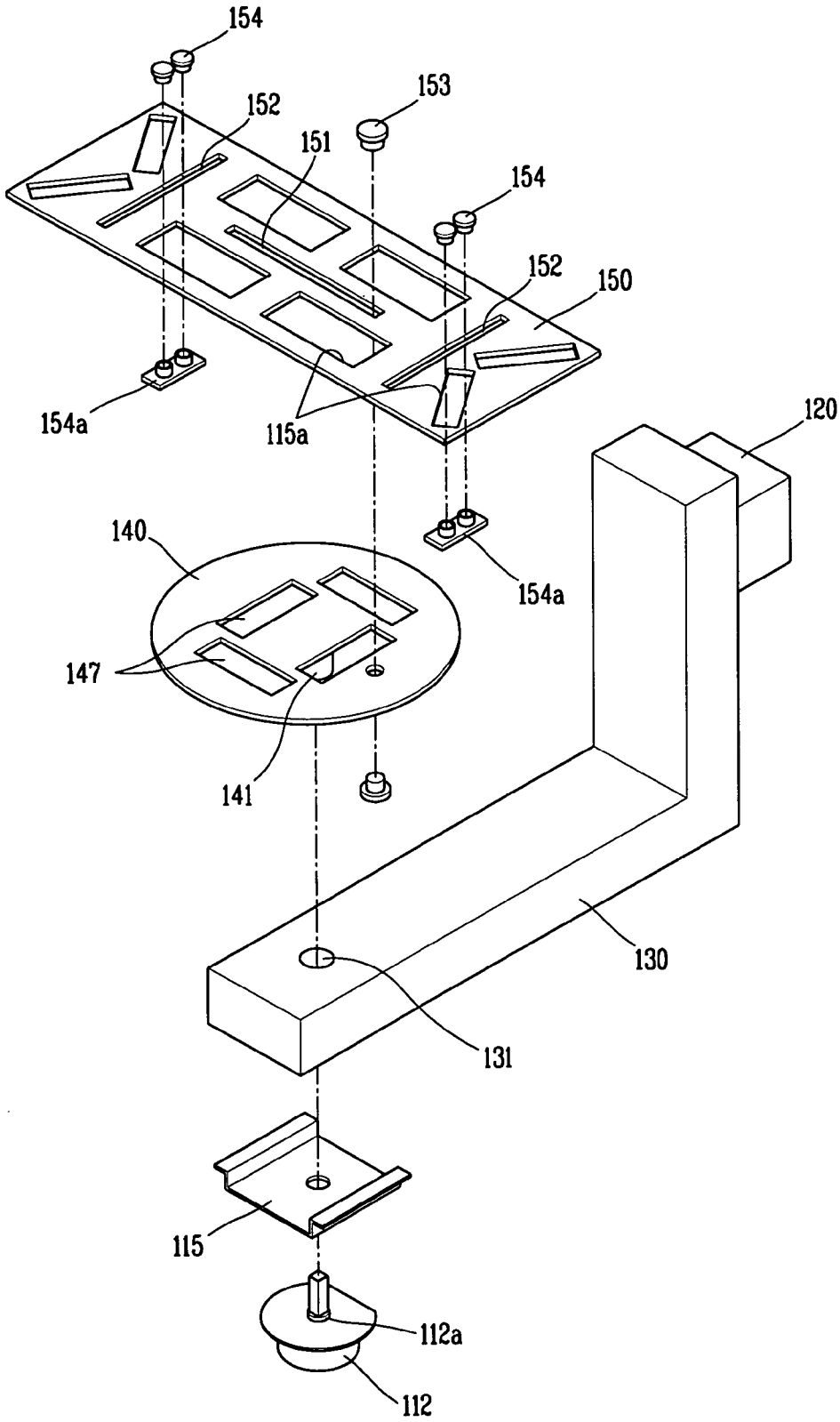
FIG. 6 is a disassembled perspective view showing the rotation antenna and the movable stirrer in the microwave cooker according to a first embodiment of the present invention.

FIG. 5 is an assembled perspective view showing a rotation antenna and a movable stirrer in the microwave cooker according to a first embodiment of the present invention, FIG. 6 is a disassembled perspective view showing the rotation antenna and the movable stirrer in the microwave cooker according to a first embodiment of the present invention, and FIGS. 7 to 10 are plane views showing an operation of the microwave cooker according to a first embodiment of the present invention.

As shown, a microwave cooker 100 according to a first embodiment of the present invention comprises a body 110 having a cooking chamber 111 therein, a microwave source 120 disposed at the body 110 for generating microwave; a wave guide 130 for guiding microwave generated from the microwave source 120 into the cooking chamber 111, a rotation antenna 140 installed in the body 110 to be rotatable by a driving motor 112 for emitting microwave guided by the guide wave 130 into the body 110, and a movable stirrer 150 coupled to the rotation antenna 140 so as to be interworked with the rotation antenna 140, and movable in back and forth directions of the cooking chamber 111.

An adjustment unit (not shown) is installed at one outer side of the body 110, and a door (not shown) is openably installed at another outer side of the body 110. A table 113 is installed at a floor of the cooking chamber 111.

The movable stirrer 150 is provided with a first guide slot 151 at a center thereof in a longitudinal direction thereof, and is provided with a second guide slot 152 at both sides thereof in a width direction thereof.

A first guide pin 153 is inserted into the first guide slot 151 of the movable stirrer 150, thereby connecting the rotation antenna 140 and the movable stirrer 150 to each other. A second guide pin 154 is inserted into the second guide slot 152 thus to be fixed to the body 110 by a fixing bracket 154*a*. A plurality of emission slots 157 are formed at the movable stirrer.

The movable stirrer 150 is formed as a rectangular plate shape having an emission area wider than that of the rotation antenna 140, and is spaced from the rotation antenna 140 with a certain gap.

A plurality of emission slots 147 are also formed at the rotation antenna 140, and an antenna feeder 141 inserted into a feeding hole 131 of the wave guide 130 is protruding from a lower portion of the rotation antenna 140.

The driving motor 112 is positioned at a lower portion of the body 110, and is supported at the wave guide 130 by a supporting bracket 115. A shaft 112*a* of the driving motor 112 penetrates the wave guide 130 thus to be fixed to the antenna feeder 141.

Once the rotation antenna 140 is rotated by the driving motor 112, the first guide pin 153 inserted into the first guide slot 151 and coupled to the rotation antenna 140 pushes the movable stirrer 150 in back and forth directions of the cooking chamber 111. As the result, the first guide pin 153 is slid along the first guide slot 151.

At the same time, the movable stirrer 150 is slid in back and forth directions of the cooking chamber 111 by the second guide pin 154 inserted into the second guide slot 152.

At least two second guide pins 154 are inserted into the second guide slot 152 of the movable stirrer 150, thereby firmly supporting the movable stirrer 150. Preferably, the rotation antenna 140 and the movable stirrer 150 are formed of a dielectric substance such as teflon, etc.

An operation of the microwave cooker according to the first embodiment of the present invention will be explained as follows.

A user puts food to be cooked on the table 113 of the cooking chamber 111, and closes the door (not shown). Then, the user operates the adjustment unit (not shown), so that microwave generated from the microwave source 120 is introduced into the cooking chamber 111 through the wave guide 130, the rotation antenna 140, and the movable stirrer 150. The microwave guided into the cooking chamber 111 is incident into the food disposed on the table 113, thereby heating and cooking the food.

The movable stirrer 150 is formed to have an emission area wider than that of the rotation antenna 140, and is interworked with the rotation antenna 140 as the rotation antenna 140 is rotated. The movable stirrer 150 is disposed to be movable in back and forth directions of the cooking chamber 111, thereby uniformly emitting microwave in the cooking chamber 111 and forming a resonant mode. Accordingly, the food can be uniformly heated.

Even if the food is biased to one side of the table, the food can be uniformly heated without a heat deviation.

That is, the movable stirrer 150 having an emission area larger than that of the rotation antenna 140 is moved in back and forth directions of the cooking chamber 111 by the rotation antenna 140, and is positioned outside the food. Therefore, emitted microwave is not directly absorbed into the food by the rotation antenna 140 and the movable stirrer 150, and a resonant mode is formed in the cooking chamber 111. A heat deviation of upper and lower sides inside the cooking chamber 111 is decreased thereby to uniformly heat food.

Referring to FIGS. 7 to 10, an operation of the rotation antenna and the movable stirrer in the microwave cooker according to the first embodiment of the present invention will be explained.

Figure 7:
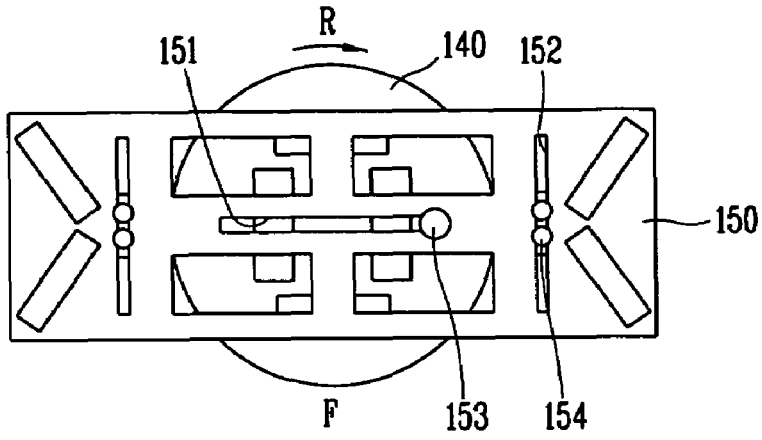
FIGS. 7 to 10 are plane views showing an operation of the microwave cooker according to a first embodiment of the present invention.
Figure 8:
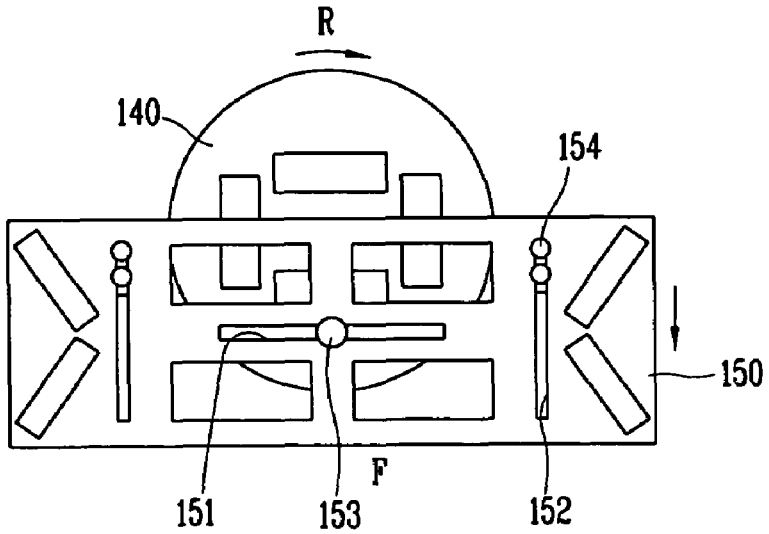

An F denotes a front side of the cooking chamber, and an R denotes a rear side of the cooking chamber. When the rotation antenna 140 is clockwise rotated by 90° by operating the driving motor 112 of FIG. 6 as shown in FIG. 7, the first guide pin 153 is positioned at the front side of the cooking chamber as shown in FIG. 8. Herein, the movable stirrer 150 is forwardly slid by the second guide slot 152 and the second guide pin 154 inserted into the second guide slot 152.

Figure 9:
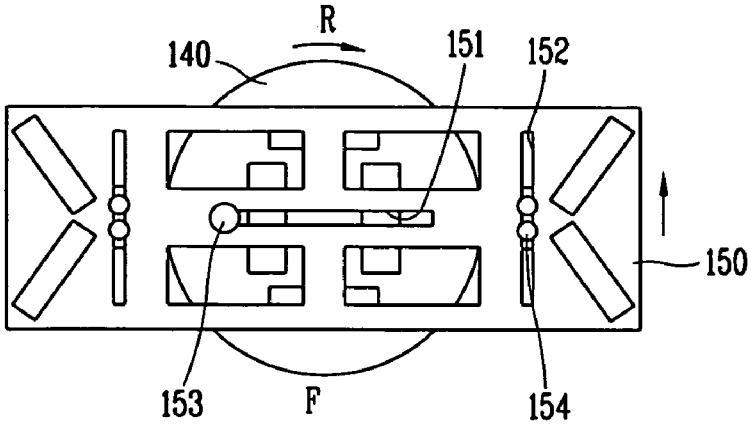
Figure 10:
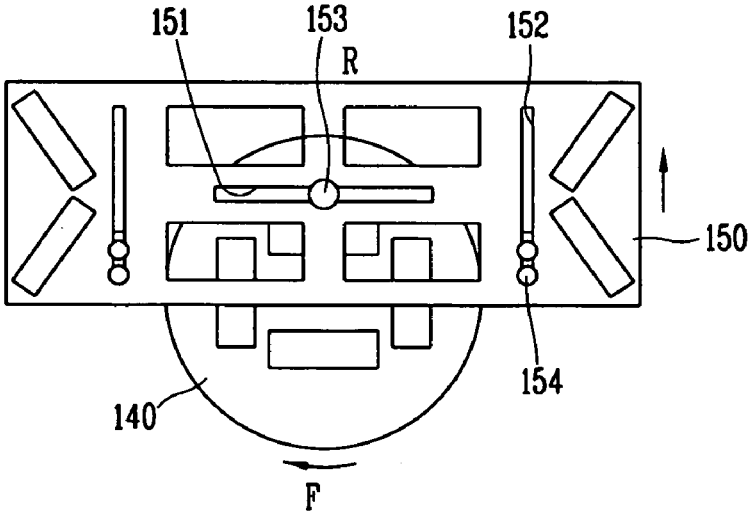

As shown in FIGS. 9 and 10, the rotation antenna 140 is further rotated clockwise by 180° by operating the driving motor 112 of FIG. 6, the first guide pin 153 is positioned at the rear side of the cooking chamber. Herein, the movable stirrer 150 is backward slid by the second guide slot 152 and the second guide pin 154 inserted into the second guide slot 152.

When the rotation antenna 140 is rotated, the first guide pin 153 is moved along the first guide slot 151. Also, the movable stirrer 150 is back and forth slid by the second guide slot 152 and the second guide pin 154 inserted into the second guide slot 152.

Hereinafter, a microwave cooker according to another embodiment of the present invention will be explained.

Figure 11:
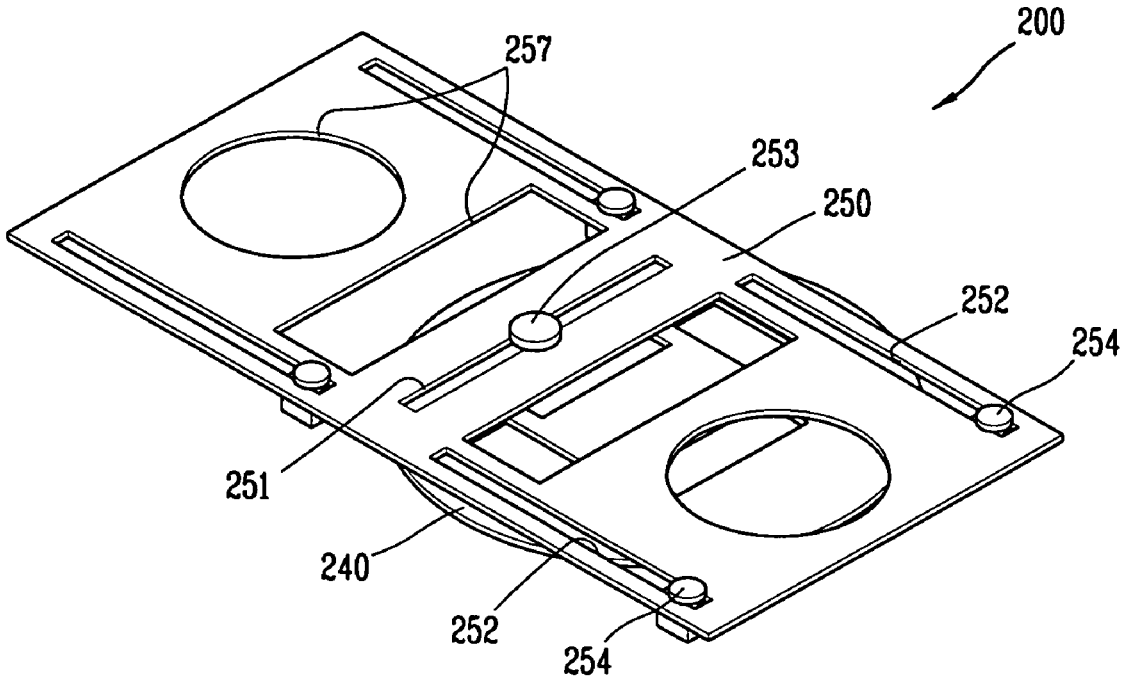
FIG. 11 is an assembled perspective view showing a rotation antenna and a movable stirrer in a microwave cooker according to another embodiment of the present invention.
Figure 12:
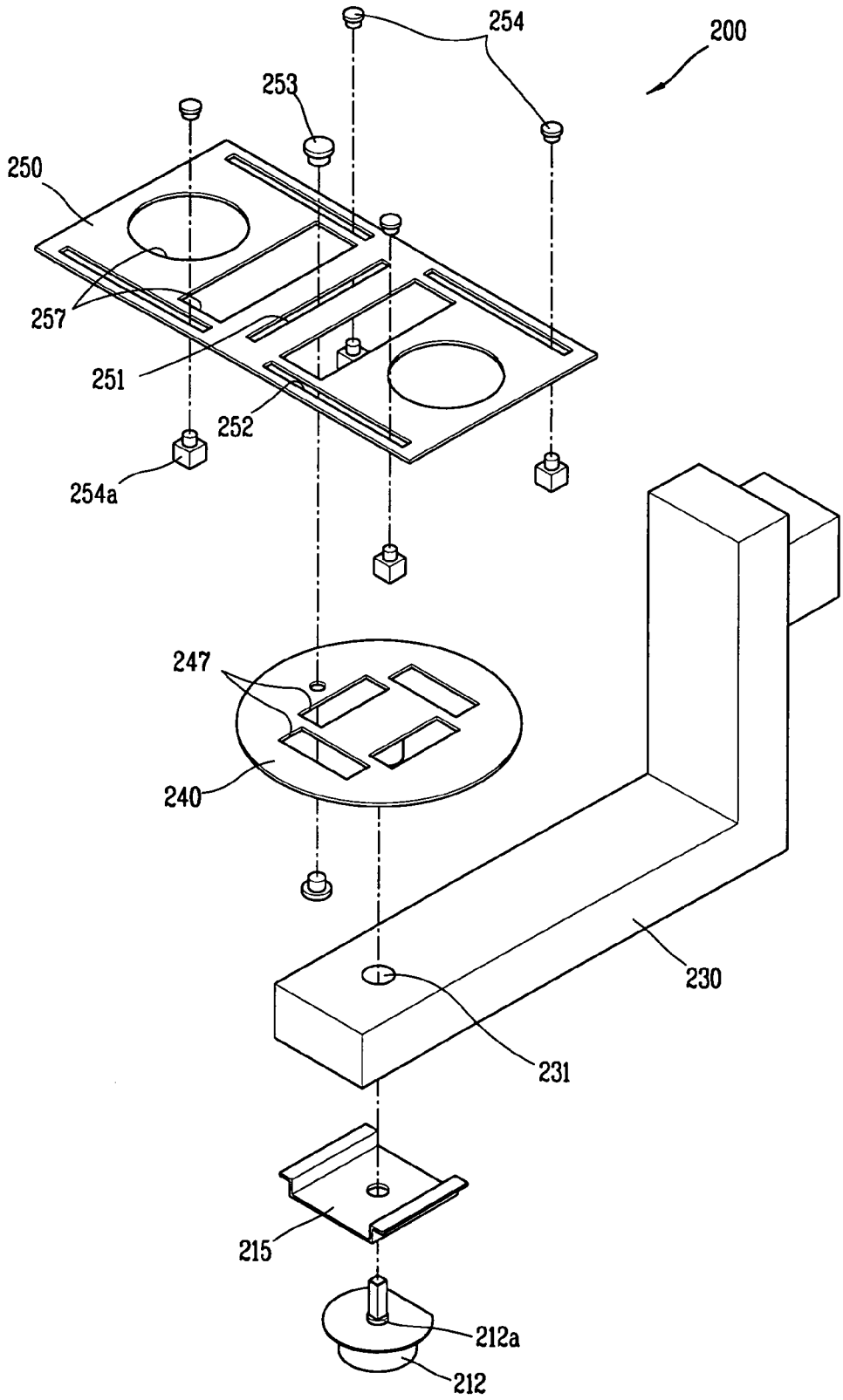
FIG. 12 is a disassembled perspective view showing the rotation antenna and the movable stirrer in the microwave cooker according to another embodiment of the present invention.
Figure 13:
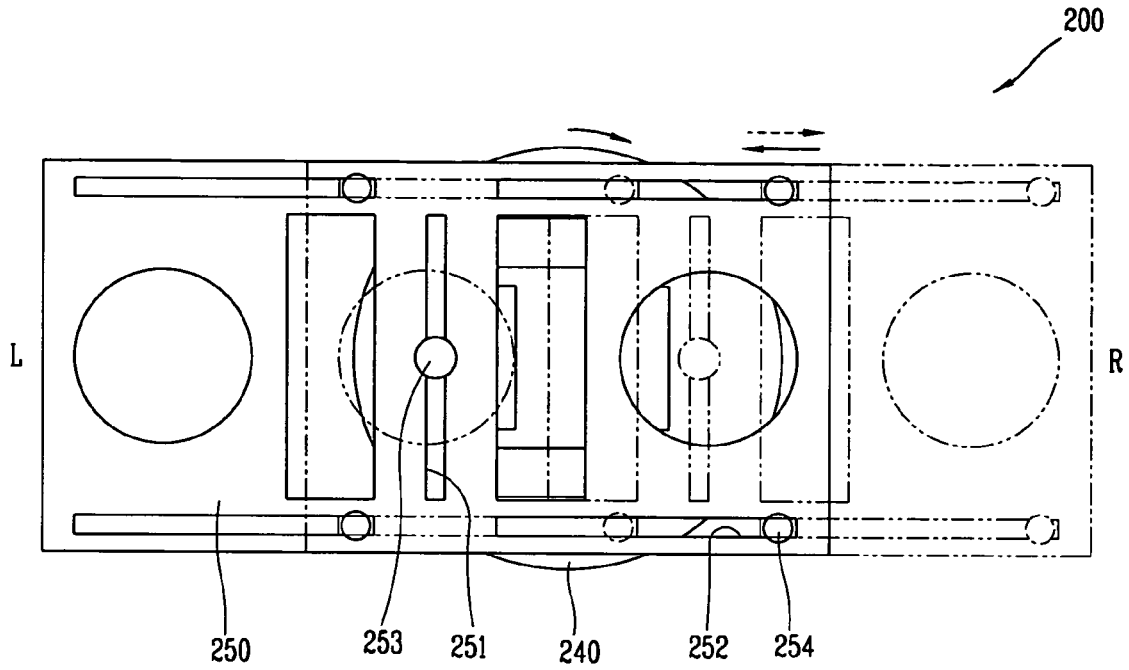
FIG. 13 is a plane view showing an operation of the microwave cooker according to another embodiment of the present invention.

As shown in FIGS. 11 to 13, a microwave cooker 200 according to another embodiment of the present invention comprises a body 210 having a cooking chamber 211 therein, a microwave source 220 disposed at the body 210 for generating microwave, a wave guide 230 for guiding microwave generated from the microwave source 220 into the cooking chamber 211, a rotation antenna 240 installed in the cooking chamber 211 to be rotatable by a driving motor 212 for emitting microwave guided by the guide wave 230 into the body 210, and a movable stirrer 250 coupled to the rotation antenna 240 so as to be interworked with the rotation antenna 240, and movable in right and left directions of the cooking chamber 211.

The movable stirrer 250 is provided with a first guide slot 251 at a center thereof in a width direction thereof, and is provided with a second guide slot 252 at both sides thereof in a longitudinal direction thereof. A first guide pin 253 is inserted into the first guide slot 252 of the movable stirrer 250, thereby connecting the rotation antenna 240 and the movable stirrer 250 to each other. A plurality of second guide pins 254 are installed at the second guide slot 252 thus to be inserted into the second guide slot 252 and to be fixed to the body 210 by a fixing bracket 254*a*.

An operation of the microwave cooker according to the second embodiment of the present invention will be explained as follows.

A user puts food to be cooked on a table (not shown) of the cooking chamber 211, and closes a door (not shown). Then, the user operates an adjustment unit (not shown), so that microwave generated from the microwave source 220 is introduced into the cooking chamber 211 through the wave guide 230, the rotation antenna 240, and the movable stirrer 250. The microwave guided into the cooking chamber 211 is absorbed into the food disposed on the table, thereby heating and cooking the food.

The movable stirrer 250 is formed to have an emission area wider than that of the rotation antenna 240, and is disposed to be movable in right and left directions of the cooking chamber 211 by the rotation antenna 240, thereby uniformly emitting microwave in the cooking chamber 211 and forming a resonant mode. Accordingly, the food can be uniformly heated.

Referring to FIG. 13, an operation of the movable stirrer by a rotation of the rotation antenna in the microwave cooker according to another embodiment of the present invention will be explained.

An R denotes a right side of the cooking chamber, and an L denotes a left side of the cooking chamber. When the rotation antenna 240 is clockwise rotated by operating the driving motor 212 of FIG. 6, the first guide pin 253 is moved along the first guide slot 251. Herein, the movable stirrer 250 is slid in right and left directions by the second guide slot 252 and the second guide pin 254 inserted into the second guide slot 252.

When the rotation antenna 240 is rotated, the first guide pin 253 is moved along the first guide slot 251. Also, the movable stirrer 250 is slid in right and left directions by the second guide slot 252 and the second guide pin 254 inserted into the second guide slot 252.

As aforementioned, the movable stirrer is moved in back and forth directions or right and left directions of the cooking chamber by a rotation of the rotation antenna, and is positioned outside the food. Therefore, emitted microwave is not directly absorbed into the food by the rotation antenna and the movable stirrer, and a resonant mode is formed in the cooking chamber. A heat deviation of upper and lower sides inside the cooking chamber is decreased thereby to uniformly heat food.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A microwave cooker, comprising:

a body having a cooking chamber therein;

a microwave source disposed at the body for generating a microwave;

a wave guide for guiding the microwave generated from the microwave source into the cooking chamber;

a rotation antenna installed in the body to be rotatable by a driving motor for emitting the microwave guided by the wave guide into the cooking chamber; and a movable stirrer coupled to the rotation antenna so as to be interworked with the rotation antenna, the movable stirrer being driven by rotation of the rotation antenna to move in back and forth directions of the cooking chamber.

2. The microwave cooker of claim 1, wherein the movable stirrer is provided with a first guide slot at a center thereof in a longitudinal direction thereof, the movable stirrer is provided with a second guide slot at both sides thereof in a width direction thereof, a first guide pin is inserted into the first guide slot of the movable stirrer thereby to connect the rotation antenna and the movable stirrer to each other, and a second guide pin is inserted into the second guide slot thus to be fixed to the body.

3. The microwave cooker of claim 2, wherein at least two second guide pins are inserted into the second guide slot of the movable stirrer.

4. The microwave cooker of claim 2, wherein the rotation antenna and the movable stirrer are formed of a dielectric substance.

5. The microwave cooker of claim 1, wherein a plurality of emission slots are formed at the movable stirrer.

6. The microwave cooker of claim 1, wherein the back and forth directions are substantially perpendicular to a rotation axis of the rotation antenna.

7. A microwave cooker, comprising:

a body having a cooking chamber therein;

a microwave source disposed at the body for generating a microwave;

a wave guide for guiding the microwave generated from the microwave source into the cooking chamber;

a rotation antenna installed in the body to be rotatable by a driving motor for emitting the microwave guided by the wave guide into the cooking chamber; and a movable stirrer coupled to the rotation antenna so as to be interworked with the rotation antenna, the movable stirrer being driven by rotation of the rotation antenna to move in right and left directions of the cooking chamber.

8. The microwave cooker of claim 7, wherein the movable stirrer is provided with a first guide slot at a center thereof in a width direction thereof, the movable stirrer is provided with a second guide slot at both sides thereof in a longitudinal direction thereof, a first guide pin is inserted into the first guide slot of the movable stirrer thereby to connect the rotation antenna and the movable stirrer to each other, and a plurality of second guide pins are installed at the second guide slot thus to be inserted into the second guide slot and to be fixed to the body.

9. The microwave cooker of claim 8, wherein the rotation antenna and the movable stirrer are formed of a dielectric substance.

10. The microwave cooker of claim 7, wherein the right and left directions are substantially perpendicular to a rotation axis of the rotation antenna.

11. A microwave cooker, comprising:

a body having a cooking chamber therein;

a wave guide for guiding a microwave generated from a microwave source into the cooking chamber;

a rotation antenna installed in the cooking chamber so as to be rotatable by a driving motor for emitting the microwave guided by the wave guide into the cooking chamber; and a movable stirrer coupled to the rotation antenna so as to be interworked with the rotation antenna, the movable stirrer being driven by rotation of the rotation antenna to move linearly.

12. The microwave cooker of claim 11, wherein the movable stirrer is provided with a first guide slot at a center thereof, the movable stirrer is provided with a plurality of second guide slots at both sides thereof, a first guide pin is inserted into the first guide slot of the movable stirrer thereby to connect the rotation antenna and the movable stirrer to each other, and a second guide pin is installed at the second guide slot thus to be inserted into the second guide slot and to be fixed to the body.

13. The microwave cooker of claim 12, wherein the rotation antenna and the movable stirrer are formed of a dielectric substance.

14. The microwave cooker of claim 12, wherein a plurality of emission slots are formed at the movable stirrer.

15. The microwave cooker of claim 11, wherein a direction of linear movement of the movable stirrer is substantially perpendicular to a rotation axis of the rotation antenna.

* * * * *